US009702560B2

(12) United States Patent
Grendel et al.

(10) Patent No.: US 9,702,560 B2
(45) Date of Patent: Jul. 11, 2017

(54) DEVICE FOR COOLING A SUPPORTING STRUCTURE OF A HEAT SHIELD, AND HEAT SHIELD

(71) Applicant: SIEMENS AKTIENGESELLSCHAFT, München (DE)

(72) Inventors: Sabine Grendel, Oberhausen (DE); Andre Kluge, Dülmen (DE)

(73) Assignee: SIEMENS AKTIENGESELLSCHAFT (DE)

( * ) Notice: Subject to any disclaimer, the term of this patent is extended or adjusted under 35 U.S.C. 154(b) by 294 days.

(21) Appl. No.: 14/429,737

(22) PCT Filed: Sep. 17, 2013

(86) PCT No.: PCT/EP2013/069215
§ 371 (c)(1),
(2) Date: Mar. 19, 2015

(87) PCT Pub. No.: WO2014/044654
PCT Pub. Date: Mar. 27, 2014

(65) Prior Publication Data

US 2015/0285496 A1 Oct. 8, 2015

(30) Foreign Application Priority Data

Sep. 21, 2012 (EP) ..... 12185435

(51) Int. Cl.
*F23R 3/00* (2006.01)
*F23M 5/04* (2006.01)
(Continued)

(52) U.S. Cl.
CPC ..... *F23R 3/002* (2013.01); *F23M 5/04* (2013.01); *F23M 5/085* (2013.01); *F23R 3/005* (2013.01);
(Continued)

(58) Field of Classification Search
CPC .. F23M 5/04; F23M 5/085; F23R 3/60; F23R 3/002; F23R 2900/03042;
(Continued)

(56) References Cited

U.S. PATENT DOCUMENTS 4,749,029 A 6/1988 Becker ..... 165/47
4,749,298 A 6/1988 Bundt ..... 403/23
(Continued)

FOREIGN PATENT DOCUMENTS

CN 88102602 A 11/1988
CN 101922728 A 12/2010
(Continued)

OTHER PUBLICATIONS

International Search Report dated Apr. 9, 2014 issued in corresponding International Patent Application No. PCT/EP2013/069215.
(Continued)

*Primary Examiner* — Gerald L Sung
*Assistant Examiner* — Stefan Ibroni
(74) *Attorney, Agent, or Firm* — Ostrolenk Faber LLP

(57) ABSTRACT

A device (20, 29, 48, 64) for cooling a supporting structure of a heat shield (33, 60) to avoid scaling of the supporting structure due to the intake of hot gas. The device has a longitudinal axis (21) and a cooling air duct (22). The device is on the supporting structure with the longitudinal axis (21) intersecting the surface (51) of the supporting structure (34). In this position, the cooling air duct (22) extends from a device end (23) pointing towards the supporting structure. The device has at least one outlet duct downstream in the cooling air duct. The duct emerges out of the device (20, 29, 48, 64) laterally with respect to the longitudinal axis (21). The cooling air duct (22) corresponds to at least one cooling air passage (50) in the supporting structure (34).

11 Claims, 7 Drawing Sheets

(51) Int. Cl.
*F23M 5/08* (2006.01)
*F23R 3/60* (2006.01)

(52) U.S. Cl.
CPC ..... *F23R 3/007* (2013.01); *F23R 3/60* (2013.01); *F23M 2900/05002* (2013.01)

(58) Field of Classification Search
CPC .. F23R 2900/03041; F23R 2900/00017; F16B 35/00; F16B 21/09
See application file for complete search history.

(56) References Cited

U.S. PATENT DOCUMENTS

| | | | | |
|---|---|---|---|---|
| 4,820,097 | A | 4/1989 | Maeda et al. | |
| 5,083,424 | A * | 1/1992 | Becker | F23R 3/007 110/336 |
| 5,431,020 | A * | 7/1995 | Maghon | E04F 13/0846 403/179 |
| 6,711,899 | B2 * | 3/2004 | Bast | F23M 5/02 110/336 |
| 7,779,637 | B2 * | 8/2010 | Heilos | F23M 5/04 60/752 |
| 8,104,287 | B2 * | 1/2012 | Fischer | F23M 5/04 60/752 |
| 8,800,292 | B2 * | 8/2014 | Bottcher | F23M 5/04 60/752 |
| 2010/0307162 | A1 | 12/2010 | Bottcher | 60/752 |
| 2011/0318531 | A1 | 12/2011 | Krusch | 428/131 |

FOREIGN PATENT DOCUMENTS

| | | | |
|---|---|---|---|
| CN | 102356276 | A | 2/2012 |
| CN | 102356277 | A | 2/2012 |
| CN | 102460022 | A | 5/2012 |
| DE | 197 30 751 | A1 | 1/1998 |
| EP | 0 224 817 | A1 | 6/1987 |
| EP | 1 126 221 | A1 | 8/2001 |
| EP | 1 701 095 | A1 | 9/2006 |
| EP | 2 261 564 | A1 | 12/2010 |

OTHER PUBLICATIONS

International Preliminary Report on Patentability dated Dec. 17, 2014 issued in corresponding International Patent Application No. PCT/EP2013/069215.
European Search Report dated Feb. 5, 2013 issued in corresponding European patent application No. 12185435.0.
Chinese Office Action, dated Mar. 2, 2016, issued in corresponding Chinese Patent Application No. 201380053375.8. Total 10 pages.

* cited by examiner

DEVICE FOR COOLING A SUPPORTING STRUCTURE OF A HEAT SHIELD, AND HEAT SHIELD

CROSS-REFERENCE TO RELATED APPLICATIONS

The present application is a 35 U.S.C. §§371 national phase conversion of PCT/EP2013/069215, filed Sep. 17, 2013, which claims priority of European Patent Application No. 12185435.0, filed Sep. 21, 2012, the contents of which are incorporated by reference herein. The PCT International Application was published in the German language.

TECHNICAL FIELD

The invention relates to a device for cooling the supporting structure of a heat shield, and to a heat shield, in particular to a heat shield for a combustion chamber of a gas turbine.

The invention relates to a combustion chamber and to a gas turbine having such a heat shield.

TECHNICAL BACKGROUND

In many technical applications, use is made of heat shields which have to stand up to hot gases at between 1000 and 1600 degrees Celsius. In particular gas turbines, such as are used in electricity-generating power plants and in aircraft engines, have accordingly large surfaces within the combustion chambers, which surfaces are to be protected by heat shields. Because of thermal expansion and because of large dimensions, the heat shield must be comprised of a multiplicity of individual, in general ceramic, heat shield tiles which are attached to a supporting structure on which they are spaced apart from one another with a sufficient gap. This gap between tiles provides the heat shield elements with sufficient space for thermal expansion. However, as the gap also makes it possible for the hot combustion gases to make direct contact with the metallic supporting structure and the holding elements, cooling air is injected, as a countermeasure, through the gaps in the direction of the combustion chamber.

A generic heat shield thus comprises a supporting structure and a number of heat shield tiles which are releasably attached to the supporting structure by means of tile holders, wherein each heat shield tile has a cold side oriented towards the supporting structure and a hot side which is opposite the cold side and which can be exposed to a hot medium. Each of the tile holders has at least one holding section for attaching to a heat shield tile and an attachment section which can be attached to the supporting structure. For the purpose of protection from hot gases, at least one cooling air passage is provided in the supporting structure.

For the purpose of attaching the tile holders to the supporting structure, circular circumferential and parallel attachment slots can be provided in the supporting structure. In this case, the tile holders are pushed one after the other with their attachment sections into the attachment slots, wherein subsequent tile holders block the position of the previously positioned tile holders. It is thus possible for a circular circumferential row of heat shield tiles to be attached to the supporting structure within a combustion chamber of a gas turbine.

EP 1 701 095 A1 discloses a heat shield of a combustion chamber of a gas turbine with a supporting structure and a number of heat shield tiles releasably arranged on the supporting structure. For the purpose of protecting the combustion chamber wall, the heat shield tiles are arranged on the supporting structure so as to cover a large area while leaving expansion gaps. Each heat shield tile has a cold side oriented towards the supporting structure and a hot side which is opposite the cold side and which can be exposed to a hot medium. The heat shield tiles are each resiliently attached to the supporting structure by means of four metallic tile holders. To that end, each tile holder comprises a holding section in the form of a gripping section and an attachment section. In every heat shield tile side, holding slots are introduced on two opposite circumferential sides, such that the gripping sections of the tile holders can engage in the opposite side holding slots in order to hold the heat shield tile. The tile holders facing the heat shield tile and attached in this manner are guided in the supporting structure with their attachment section in an attachment slot running beneath the heat shield tile. To provide protection from hot gases, the gripping sections of the metallic tile holders are cooled. To that end, openings are introduced into the tile holders in the region of the holding section and into the holding bars of the heat shield tiles, which openings are flush with a cooling air bore arranged in the supporting structure, such that cooling air flowing in a direct line from the cooling air bore impinges on a cold side of the gripping section.

In spite of this cooling of the gripping sections according to the prior art, it is possible when the heat shield is exposed to hot gas for hot gas to penetrate into the region of the expansion gaps between the heat shield tiles. The hot gas can then propagate beneath the heat shield and can cause scaling on the supporting structure.

SUMMARY OF THE INVENTION

The invention therefore has the object of providing a device for cooling the supporting structure of a heat shield, so that scaling of the supporting structure due to hot gas ingress can be effectively avoided.

The object is achieved according to the invention with a device for cooling the supporting structure of a heat shield of the type mentioned in the introduction. The device comprises a longitudinal axis and a cooling air duct, wherein the device with the longitudinal axis can be arranged on the supporting structure perpendicular to the surface of the supporting structure. In this position, the cooling air duct extends from one end of the device oriented towards the supporting structure and comprises, downstream, at least one outlet duct. The at least one outlet duct exits the device laterally with respect to the longitudinal axis. The device can be arranged on the supporting structure such that the cooling air duct lines up with at least one cooling air passage arranged in the supporting structure.

According to the invention, it is thus possible in the case of heat shield tiles arranged on the supporting structure for cooling air to be made to flow into the interspace between the cold side of the heat shield tile and the supporting structure. In this context, the cooling air can be introduced into the interspace from a position which is raised above the supporting structure by means of the device. In addition, the cooling air flows laterally from the device into the interspace. This avoids damage to the heat shield tiles by impingement cooling and the cooling air spreads out beneath the heat shield tiles without immediately escaping through the expansion gaps between the heat shield tiles. This allows effective cooling of the supporting structure of the heat shield while avoiding damage to the heat shield tiles.

That the cooling air duct (in the case of a device arranged on the supporting structure) lines up with at least one cooling air passage arranged in the supporting structure is to be understood as meaning that at least some of the cooling air exiting the at least one cooling air passage enters the cooling air duct. For example, the cooling air duct and the cooling air passage may be flush with one another or adjoin one another. The cooling air passage can for example be a cooling air bore arranged in the supporting structure, into which the device can be screwed with its end oriented towards the supporting structure.

The longitudinal axis of the device need not be identical with a longitudinal axis predefined by the shape of the body. It is imaginary and, in the case of a device arranged on the supporting structure, runs through the attachment region of the device and perpendicular to the surface of the supporting structure. Surface irregularities need not be taken into account here.

That the device can be arranged on the supporting structure in order to cool the supporting structure also conceptually includes such devices which are partially sunk into the supporting structure and attached therein, or which are arranged within a recess running in the supporting structure.

It can advantageously be provided that the device may be a post, and more particularly the post may be a set screw with an integrated cooling air duct therein. This development of the invention is of particularly simple construction and thus involves low production costs.

It can further advantageously be provided that the at least one outlet duct runs radially with respect to the longitudinal axis.

The cooling air issuing from the outlet duct thus flows parallel to the supporting structure from a raised position into the interspace between heat shield tiles and supporting structure. This makes it possible to cool a wide region of the supporting structure and at the same time avoids impingement cooling of the heat shield tiles.

It can also be considered advantageous that the device comprises two opposite outlet ducts.

This configuration of the invention is particularly well-suited to cooling an attachment slot in the supporting structure.

It can also be considered advantageous that the device has four outlet ducts.

This permits even cooling of the supporting structure regions arranged around the device.

The invention has the further object of proposing a heat shield of the type mentioned in the introduction, with which scaling of the supporting structure due to hot gas ingress can be particularly effectively avoided.

To that end, and in order to provide protection from hot gases, the heat shield comprises at least one cooling air passage in the supporting structure, at which an above described post or set screw is arranged.

The expression "the device is arranged at the cooling air passage" is to be understood in this context as meaning that the cooling air duct encompassed by the device lines up with the cooling air passage.

The device may for example be arranged on the supporting structure beneath the region where two expansion gaps intersect. In this region, only by means of a device having a corresponding number of outlet ducts is it possible to inject cooling air beneath the four adjacent heat shield tiles, into the respective interspace between the cold side of the heat shield tile and the supporting structure.

Preferably, however, the device is arranged on the supporting structure beneath a heat shield tile.

The expression "beneath a heat shield tile" is to be understood in this context as meaning that the device is arranged in a region of the supporting structure which is oriented towards the cold side of the heat shield tile.

In accordance with this development of the invention, the device can in particular be arranged beneath a heat shield tile in the vicinity of an attachment section of a tile holder. In this context, the outlet ducts which open out laterally can be inclined in the direction of the supporting structure and positioned such that the at least one issuing cooling air jet is oriented towards those structures which hold the tile holders in their attachment.

Advantageously, the attachment sections of the tile holders are releasably attached within attachment slots running in the supporting structure and the cooling air passage opens into the bottom of the attachment slot. In this context, the device is arranged in the bottom of the slot at the cooling air passage.

According to this development of the invention, in order to install and remove the heat shield tiles, either the device has to be removed or it is arranged in the bottom of the slot such that the tile holders can be pushed away through the attachment slot, over the device.

According to one advantageous embodiment of the invention, the device is arranged beneath a heat shield tile essentially centrally between two attachment sections of the tile holders.

In other words, the device is located between two attachment sections of two opposite tile holders which hold a common heat shield tile at opposite sidewalls of the heat shield tile. In this manner, the cooling air issuing from the device can be injected beneath the heat shield tile without the tile holders blocking the flow path of the cooling air.

It can advantageously be further provided that a cooling air slot runs in the bottom of the attachment slot and the device is sunk into the cooling air bore at least at the level of the bottom of the slot, wherein the outlet ducts of the device open into the cooling air slot.

In particular, the device according to this development of the invention may be arranged in the cooling air slot such that it does not project above the bottom of the attachment slot. It is thus possible for the tile holders to be pushed away in the attachment slot, over the device. This allows straightforward installation and removal of the heat shield tiles for repair and maintenance purposes.

It can also be regarded as advantageous that the cooling air slot comprises a runout at its ends.

This allows the egress of the cooling air from the cooling air slot to have improved flow characteristics. According to one advantageous embodiment of the invention, the supporting structure and the device can line up with one another such that the device can be sunk into the supporting structure for installing and removing the heat shield tiles.

In order to sink the device into the supporting structure, it can for example be possible to screw the entire device into the supporting structure. According to another configuration of the development, it can be possible for the device to be arranged on the supporting structure in two positions, it being possible to switch between these positions. In that context, a first position with the longitudinal axis perpendicular to the surface of the supporting structure serves for introducing cooling air and a second position with the longitudinal axis parallel to the surface of the supporting structure serves for sinking the device.

The invention has the further object of proposing a combustion chamber and a gas turbine with at least one combustion chamber, with which scaling of the supporting structure of a heat shield included in the combustion chamber, due to hot gas ingress, can be particularly effectively avoided.

The object is achieved according to the invention, in the case of a combustion chamber and a gas turbine of the type mentioned in the introduction.

Further expedient configurations and advantages of the invention form the subject matter of the description of exemplary embodiments of the invention with reference to the figures of the drawing, wherein identical reference signs relate to components having the same effect.

DESCRIPTION OF EMBODIMENTS

Figure 1:
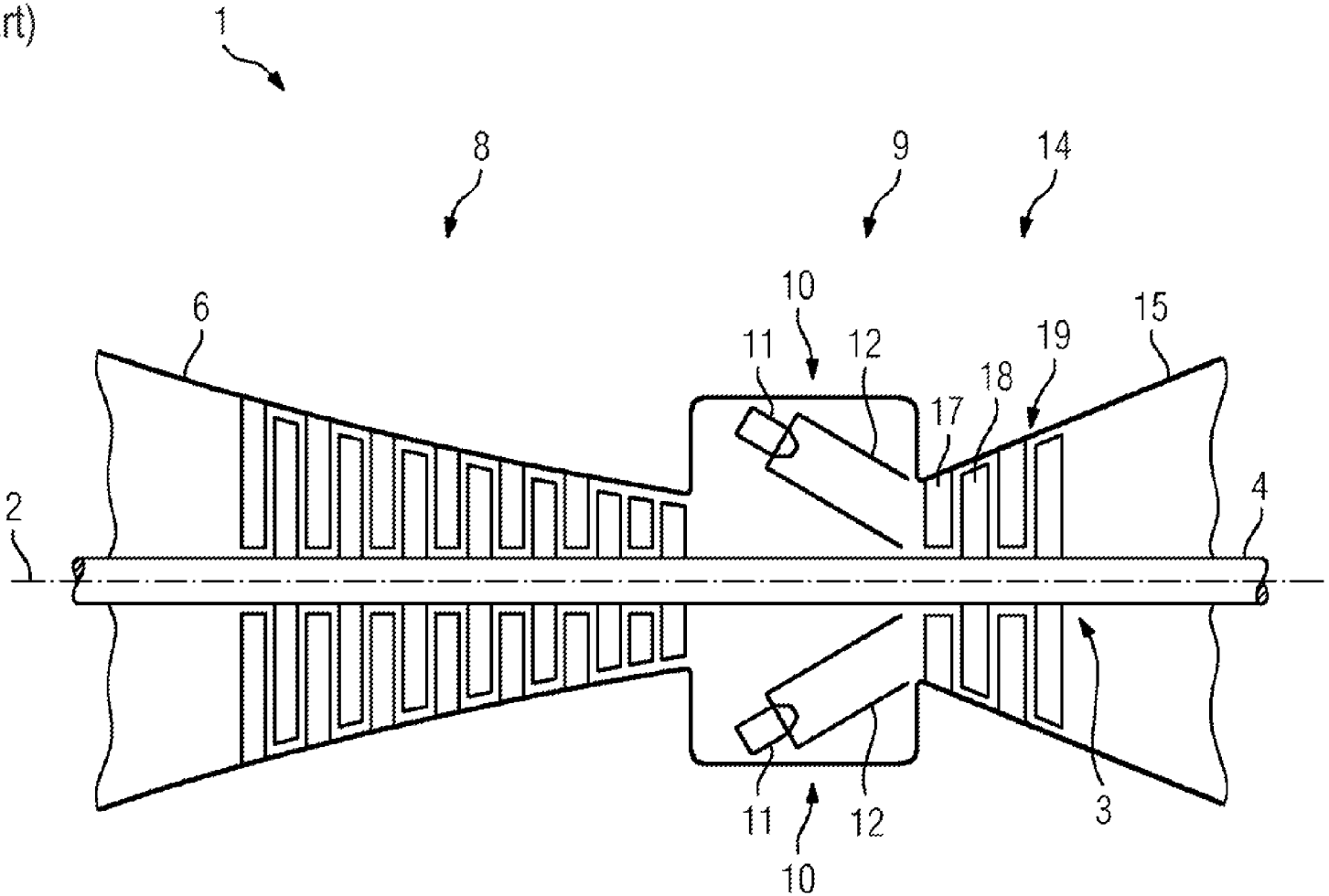
FIG 1 (Prior Art)
FIG. 1 is a schematic representation of a gas turbine according to the prior art.

FIG. 1 is a schematic sectional view of a gas turbine 1 according to the prior art. The gas turbine 1 has, internally, a rotor 3 which is mounted to rotate about an axis of rotation 2 and which also has a shaft 4 which is also termed the turbine rotor. Along the rotor 3 there are, in sequence, an intake casing 6, a compressor 8, a combustion system 9 with a number of combustion chambers 10 which each comprise a burner arrangement 11 and a casing 12, a turbine 14 and an exhaust casing 15. For protection from hot gases, the casing 12 is clad with a heat shield (not shown).

The combustion system 9 communicates with for example an annular hot gas duct. There, multiple series-connected turbine stages form the turbine 14. Each turbine stage is formed from blade rings. As seen in the flow direction of a working medium, in the hot duct a row formed of stator vanes 17 alternates with a row formed of rotor blades 18. The stator vanes 17 are attached to an internal casing of a stator 19, whereas the rotor blades 18 of a row are attached to the rotor 3 by means of a turbine disk for example. Coupled to the rotor 3 is for example a generator (not shown).

When the gas turbine is in operation, air is drawn in by the compressor 8 through the intake casing 6 and compressed. The compressed air which is made available at the turbine-side end of the compressor 8 is directed to the combustion system 9 and there it is mixed with fuel in the region of the combustion arrangement 11. The mixture is then combusted in the combustion system 9, with the aid of the combustion arrangement 11, forming a working gas flow. Thence, the working gas flow flows along the hot gas duct past the stator vanes 17 and the rotor blades 18. On the rotor blades 18, the working gas flow expands, transmitting an impulse so that the rotor blades 18 drive the rotor 3 and this drives the generator (not shown) which is coupled to the latter.

Figure 2:
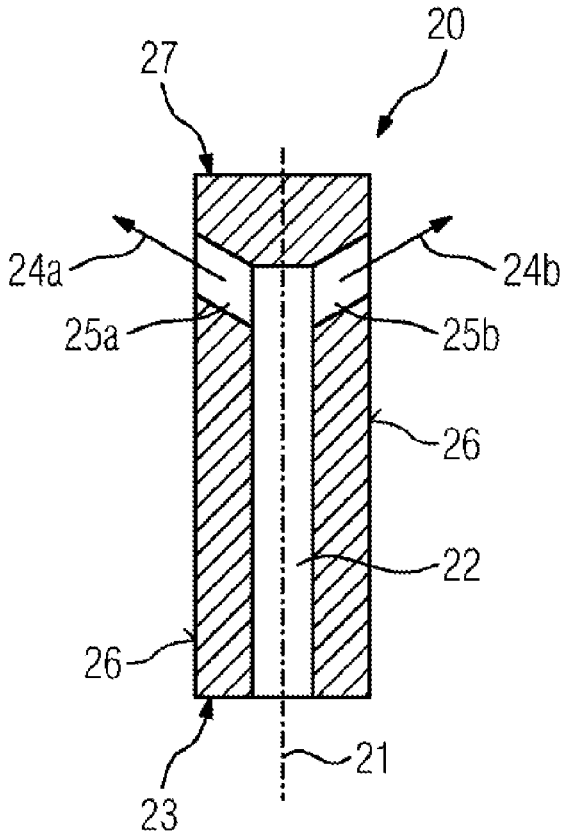
FIG. 2 is a schematic sectional view of a device according to the invention for cooling a supporting structure of a heat shield, according to a first exemplary embodiment.

FIG. 2 shows, schematically, in a section view a device 20 according to the invention for cooling a supporting structure of a heat shield, according to a first exemplary embodiment. The device 20 has a longitudinal axis 21 and comprises a cooling air duct 22. The cooling air duct 22 extends from one end 23 of the device and comprises, downstream, two outlet ducts 25*a* and 25*b* which exit the device laterally with respect to the longitudinal axis 21 and which are arranged opposite one another. According to the represented exemplary embodiment, the device may be a post, and more particularly the post may be set screw with a cooling air duct 22 running inside the set screw. The represented device 20 can also be termed a cooling grub. The set screw has, on its lateral surface 26, a thread (not shown). The thread can for example extend in the region of the end 23 over the lateral surface 26 or extend to the opposite end 27. The device 20 can be arranged with its end 23 on a supporting structure of a heat shield. For example, the post, set screw or cooling grub is screwed into a cooling air bore, provided with an internal thread, in the supporting structure. In this position, cooling air issuing from the cooling air bore can be guided into the cooling air duct 22, such that the cooling air flows downstream through the outlet ducts 25*a*, 25*b*, and leaves the cooling grub in the directions labeled 24*a* and 24*b*.

Figure 3:
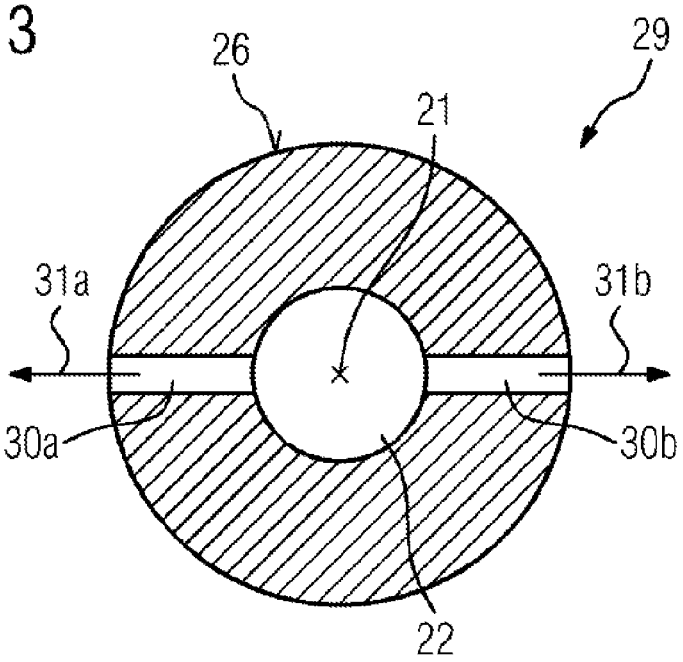
FIG. 3 is a schematic sectional view through a device according to the invention for cooling the supporting structure, according to a second exemplary embodiment.

FIG. 3 shows a cross section of a device 29 according to the invention for cooling a supporting structure, according to a second exemplary embodiment of the invention. The cross section runs perpendicular to the longitudinal axis 21 at the level of the outlet ducts 30*a* and 30*b*. The represented device 29 differs from the post, set screw or cooling grub represented in FIG. 2 only in the angle with respect to the longitudinal axis 21 at which the outlet ducts 30*a* and 30*b* leave the device laterally. In the represented exemplary embodiment, the outlet ducts run radially with respect to the longitudinal axis 21 and are arranged opposite one another. Cooling air flowing through the cooling air duct 22 is divided downstream into the outlet ducts 30*a* and 30*b*, and exits the cooling grub in the represented outflow directions 31*a* and 31*b*.

Figure 4:
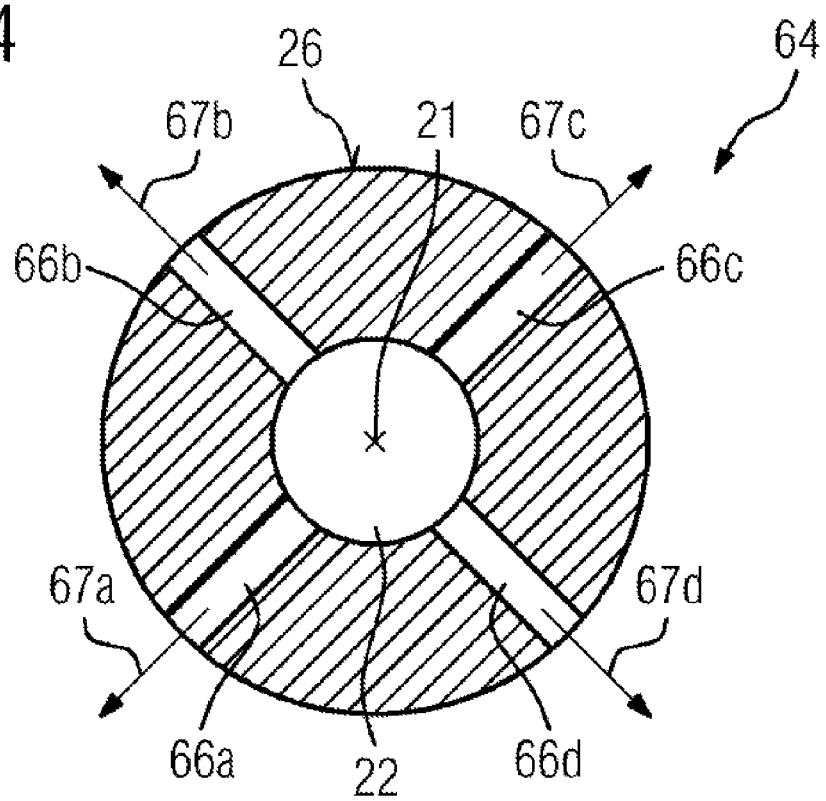
FIG. 4 is a schematic sectional view of a device according to the invention, according to a third exemplary embodiment.

FIG. 4 shows a cross section of a device 64 according to the invention for cooling a supporting structure, according to a third exemplary embodiment of the invention. The cross section runs perpendicular to the longitudinal axis 21 at the level of the outlet ducts 66*a*, 66*b*, 66*c* and 66*d*. The represented device 64 differs from the post, set screw or cooling grub represented in FIG. 3 only in the number of outlet ducts. The represented exemplary embodiment comprises four outlet ducts which run radially with respect to the longitudinal axis 21 and are arranged in pairs opposite one another. Cooling air flowing through the cooling air duct 22 is divided downstream into the outlet ducts 66*a*, 66*b*, 66*c* and 66*d*, and exits the cooling grub 64 in the represented directions 67*a*, 67*b*, 67*c* and 67*d*.

Figure 5:
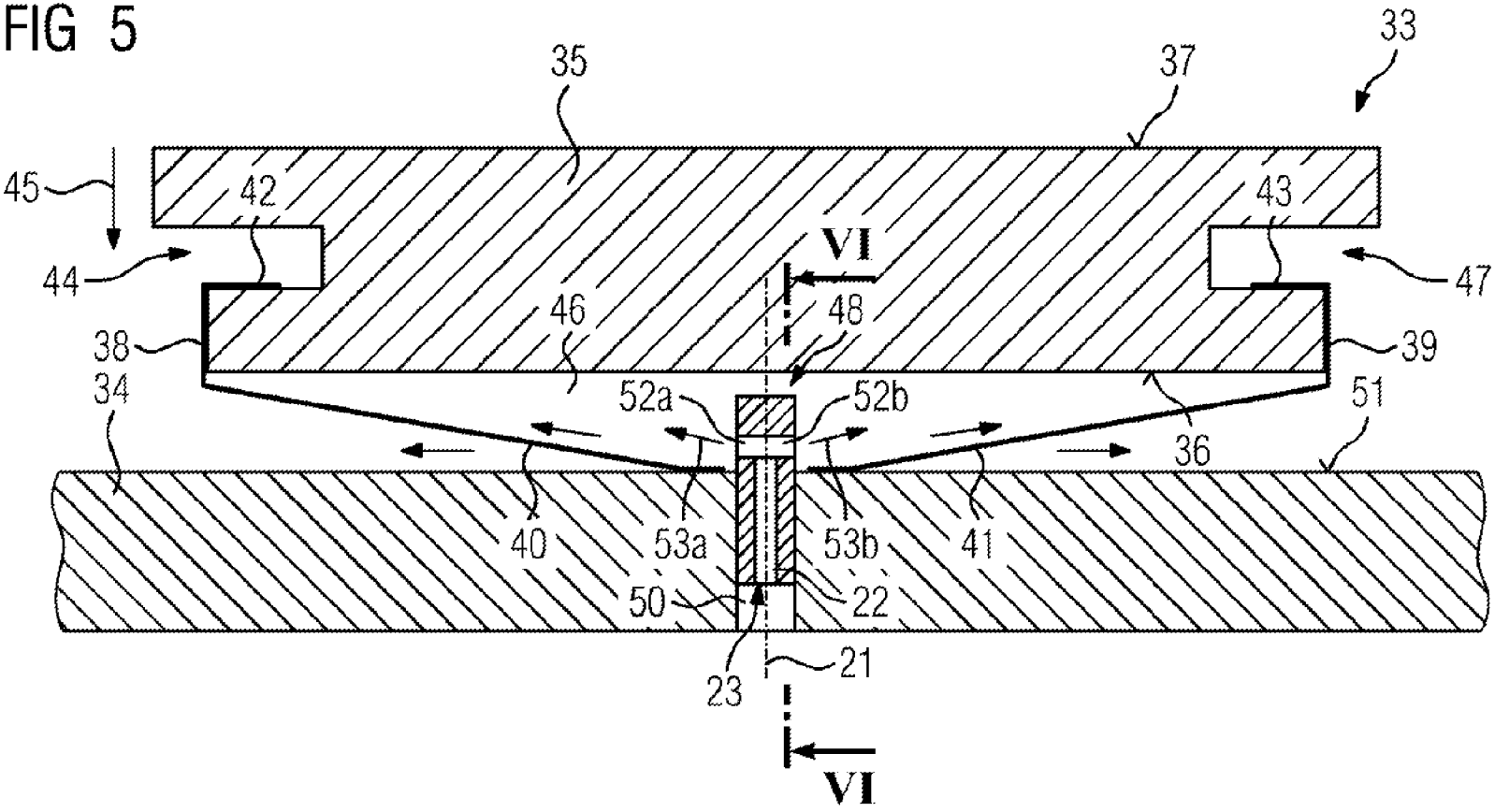
FIG. 5 is a schematic sectional view of a detail of a heat shield according to the invention arranged on the supporting structure with a device for cooling the supporting structure, according to a fourth exemplary embodiment.

FIG. 5 shows a detail of a heat shield 33 according to the invention with a supporting structure 34 and a number of heat shield tiles, of which a heat shield tile 35 is represented by way of example in the figure. The heat shield tile 35 has a cold side 36 oriented towards the supporting structure 34 and a hot side 37 which is opposite the cold side 36 and which can be exposed to a hot medium. The heat shield tile 35 is attached to the supporting structure 34 by means of tile holders 38 and 39. To that end, the tile holders 38, 39 on one hand are attached to the supporting structure 34 with their attachment sections 40, 41 and on the other hand grip with their holding sections 42, 43 in holding slots 44, 47 on opposing sidewalls of the heat shield tile 35. With the heat shield tile 35 resiliently held on the supporting structure 34 in this manner, when the hot side 37 is exposed to hot gases, it is possible for the hot gases to enter the expansion gaps between adjacent heat shield tiles. The gases penetrating in the direction 45 then propagate beneath the heat shield tile 35 in the interspace 46 which extends from the cold side 36 of the heat shield tile 35 to a surface region of the supporting structure 34 facing the heat shield tile 35. This can result in scaling of the supporting structure 34 beneath the heat shield tile 35.

To provide protection from hot gases, a device 48 according to the invention for cooling the supporting structure 34 is arranged on the supporting structure 34 beneath the heat shield tile. According to the represented exemplary embodiment, the device 48 according to the invention is a post, set screw or cooling grub with a longitudinal axis 21 and a cooling air duct 22. The device 48 can thus also be termed a cooling grub 48. The post, set screw or cooling grub 48 is arranged on the supporting structure with its longitudinal axis 21 perpendicular to the surface 51 of the supporting structure, wherein the post cooling grub 48 is screwed into a cooling air passage 50 of the supporting structure with an end 23 oriented towards the supporting structure. The cooling air passage 50 is embodied as a cooling air bore. The cooling air duct 22 extends from the screwed-in end 23 and comprises, downstream, two outlet ducts 52*a*, 52*b* which exit the cooling grub 48 laterally with respect to the longitudinal axis 21. The cooling air bore 50 and the cooling air duct 22 line up with each other so that cooling air flowing out of the cooling air bore enters the cooling air duct 22 and, by means of the cooling grub 48, flows in the directions 53*a*, 53*b* into the interspace 46. The cooling air is thus introduced beneath the heat shield tile 35 far from the expansion gaps. This permits particularly effective cooling of the supporting structure. In addition, according to the invention, impingement cooling of the heat shield tile 35 is avoided. Since the post, set screw or cooling grub 48 in the represented exemplary embodiment is arranged between two attachment sections 40, 41 of the tile holders 38, 39, centrally beneath the heat shield tile 35, in particular those regions of the supporting structure to which the tile holders are attached are cooled. It is also possible for the length of the cooling air bore 50 to be chosen such that the cooling grub 48 can be entirely sunk into the former during installation and removal of the heat shield tiles.

Figure 6:
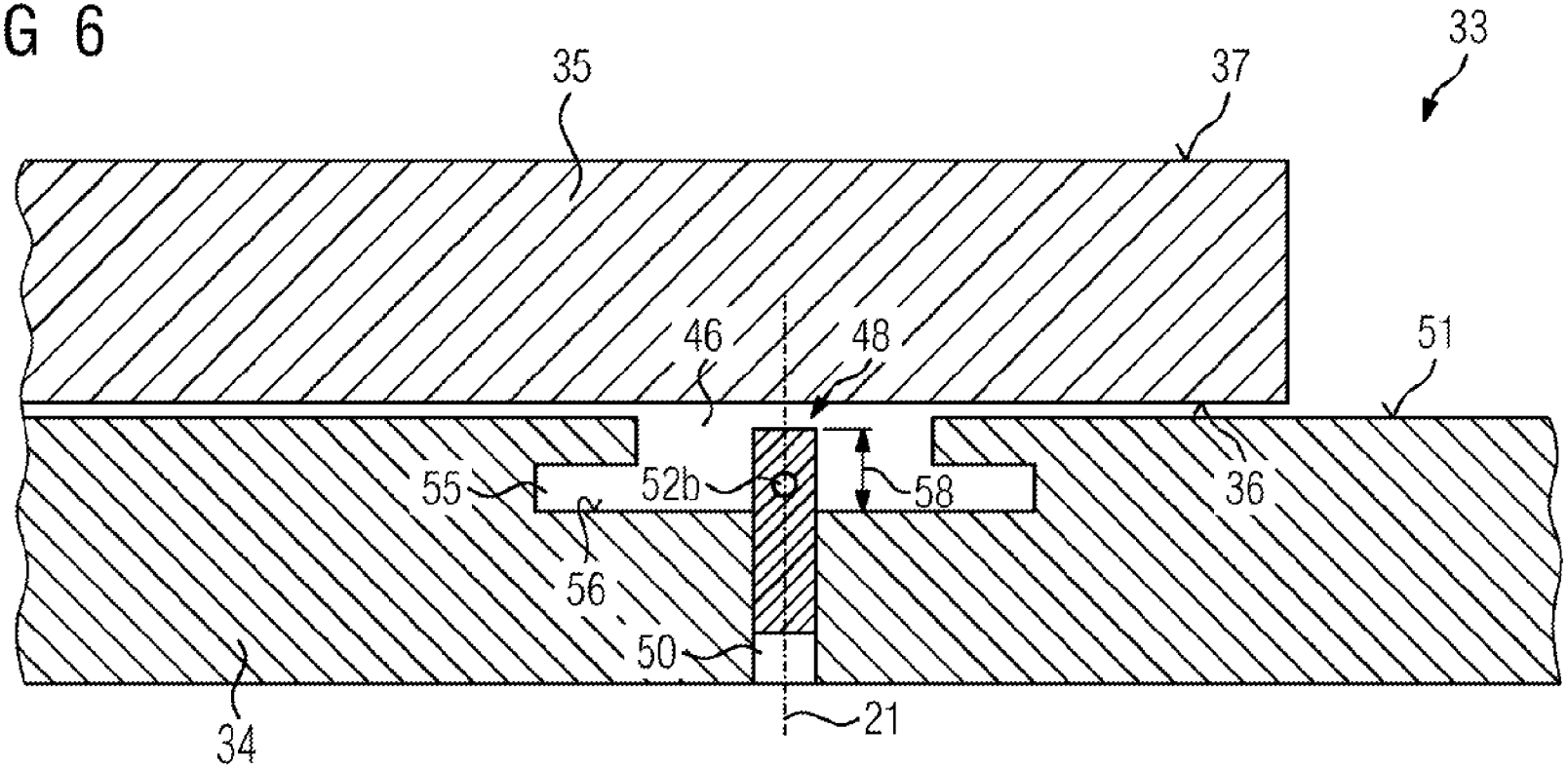
FIG. 6 is a schematic sectional view of the heat shield represented in FIG. 5 along a plane denoted by the arrows VI-VI in FIG. 5.

FIG. 6 shows the heat shield 33 represented in FIG. 5, in a further section view along the plane denoted by the arrows VI-VI. This view shows that the tile holders are held on the supporting structure 34 with their attachment sections in an attachment slot 55. The post, set screw or cooling air bore 50 opens into the bottom 56 of this attachment slot 55. The cooling grub 48 is arranged in the bottom 56 of the slot at the cooling air bore 50 with the longitudinal axis 21 perpendicular to the surface 51 of the supporting structure 34, and projects by a portion 58 out of the bottom 56 of the slot. The portion 58 is in this case chosen such that the post, set screw or cooling grub 48 does not touch the cold side 36 of the heat shield tile 35 and such that the cooling air flows out of the outlet ducts 52*a*, 52*b* into the attachment slot 55 and, on account of the position of the cooling grub 48 arranged between the tile holders, enters the interspace 46.

Figure 7:
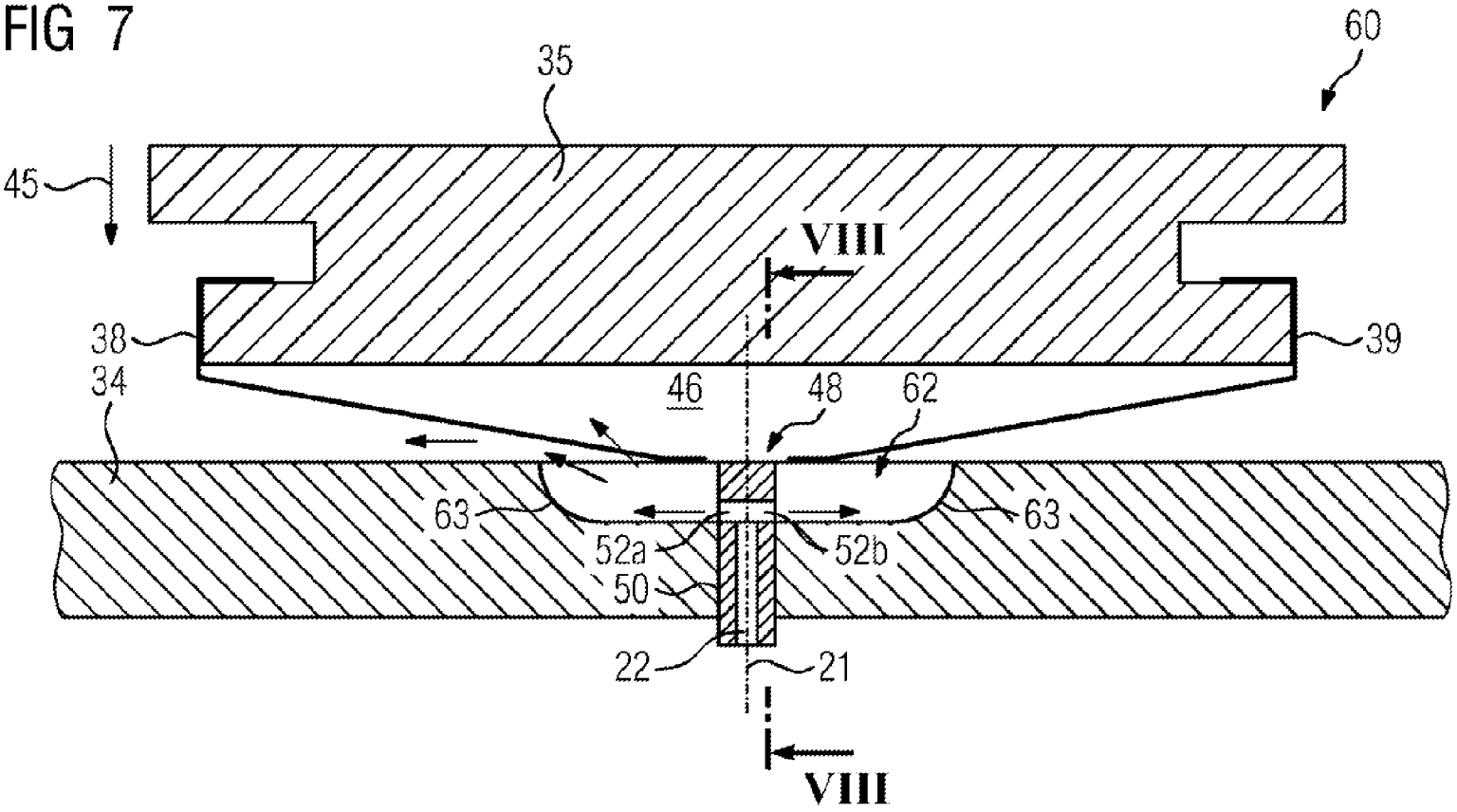
FIG. 7 is a schematic sectional view of a detail of a heat shield according to a fifth exemplary embodiment in a section view.

FIG. 7 shows a detail of a heat shield 60 according to the invention, according to a fifth exemplary embodiment. This differs from that represented in FIG. 5 in that, in addition, a cooling air slot 62 runs in the bottom of the attachment slot. The post, set screw or cooling grub 48 is sunk into the cooling air bore 50 to the level of the bottom of the attachment slot, wherein the outlet ducts 52*a*, 52*b* of the post, set screw or cooling grub 48 open into the cooling air slot 62 in the longitudinal direction. This has the advantage that the tile holders can be moved away through the attachment slot, over the post, set screw or cooling grub 48 for installing and removing the heat shield tiles 35. The function of the cooling grub 48 is thus maintained. The cooling air which flows out of the cooling grub 48 and whose flow directions are represented for the sake of example with arrows, is injected into the cooling air slot 62 and flows at the ends thereof by means of a runout 63 into the interspace 46 between the cold side of the heat shield tile 35 and the supporting structure 34 and cools the supporting structure 34 beneath the heat shield tile 35 while avoiding impingement cooling of the latter.

Figure 8:
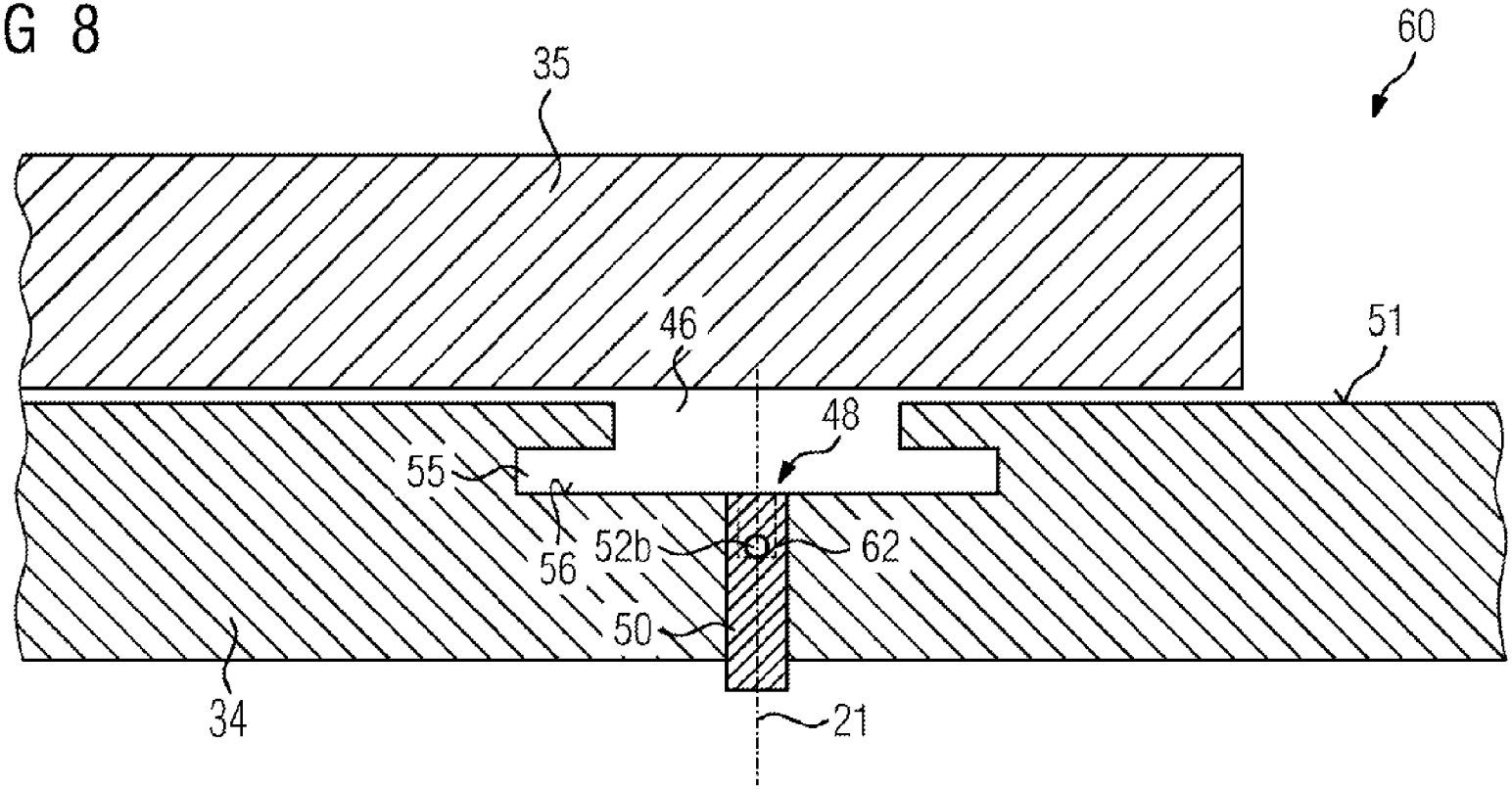
FIG. 8 is a schematic sectional view of the heat shield represented in FIG. 7 along a plane denoted by the arrows VIII-VIII in FIG. 7.

FIG. 8 shows the heat shield 60 represented in FIG. 7 in a section view along the plane denoted by the arrows VIII-VIII. The tile holders (not shown in this view) which attach the heat shield tiles 35 to the supporting structure 34 are held on the supporting structure 34 with their attachment sections in the attachment slot 55. The cooling air bore 50 opens into the bottom 56 of this attachment slot 55. The post, set screw or cooling grub 48 is arranged in the bottom 56 of the slot at the cooling air bore 50 with the longitudinal axis 21 perpendicular to the surface 51 of the supporting structure 34, and is sunk into the cooling air bore 50 to the level of the bottom 56 of the slot. It is thus possible for the tile holders to be displaced freely in the attachment slot 55 for installing and removing the heat shield tiles 35. The cooling air issuing from the outlet ducts 52*a*, 52*b* of the post, set screw or cooling grub 48 flows first into the cooling air slot 62 and thence into the interspace 46. There, the cooling air can spread and effectively cool the supporting structure beneath the heat shield tile 35.

The invention claimed is:

1. A heat shield cooling device for a combustion chamber of a gas turbine, the cooling device comprising:

a supporting structure, a plurality of heat shield tiles, tile holders releasably attaching the plurality of heat shield tiles to the supporting structure;

each heat shield tile of the plurality of heat shield tiles has a cold side oriented towards the supporting structure and an opposite hot side which is exposed to a hot medium;

each tile holder has a holding section for attaching to a heat shield tile of the plurality of heat shield tiles and an attachment section attached to the supporting structure for protecting the supporting structure from effects of hot gases;

at least one cooling air passage arranged in the supporting structure;

a post with a longitudinal axis and a cooling air duct extending through the post, the post is arranged on at least one of the at least one cooling air passage and the at least one of the at least one cooling air passage communicates cooling air into the cooling air duct for cooling the supporting structure;

the post is on the supporting structure and is above a surface of the supporting structure, the cooling air duct extends through the post from the at least one of the at least one cooling air passage, downstream to at least one outlet duct that exits the post laterally with respect to the longitudinal axis; and the post on the supporting structure is located beneath a heat shield tile of the plurality of heat shield tiles, such that the at least one outlet duct of the post opens into an interspace between the cold side of the heat shield tile of the plurality of heat shield tiles and the supporting structure wherein the attachment section extends from the surface of the supporting structure at the post along a direction within the interspace, and the direction comprises a direction component parallel to the surface of the supporting structure.

2. The heat shield cooling device as claimed in claim 1, wherein the at least one outlet duct runs radially with respect to the longitudinal axis.

3. The heat shield cooling device as claimed in claim 1, further comprising at least two oppositely directed ones of the at least one outlet ducts.

4. The heat shield cooling device as claimed in claim 2, wherein the post has four of the at least one outlet ducts.

5. The heat shield cooling device as claimed in claim 1, further comprising:

attachment slots running in the supporting structure, the attachment sections of the tile holders are releasably attached in the attachment slots; and the at least one cooling air passage opens into a bottom of the attachment slot, and the post is arranged in the bottom of the attachment slot at the at least one cooling air passage.

6. The heat shield cooling device as claimed in claim 5, further comprising the post is between two of the attachment sections of the tile holders.

7. The heat shield as claimed in claim 5, further comprising a cooling air slot in the bottom of the attachment slot, the post is sunk into the at least one of the at least one cooling air passage at least at the level of the bottom of the attachment slot, and the at least one outlet ducts of the post open into the cooling air slot.

8. The heat shield cooling device as claimed in claim 7, further comprising the cooling air slot comprises a runout at each ends of the cooling air slot.

9. The heat shield cooling device as claimed in claim 1, further comprising the supporting structure and the post are aligned such that the post is sunk into the supporting structure for enabling installing and removing of the plurality of heat shield tiles without interference from the post.

10. A combustion chamber which is clad with a heat shield, wherein the heat shield cooling device is as claimed in claim 1.

11. A gas turbine with at least one combustion chamber, wherein the at least one combustion chamber is as claimed in claim 10.

* * * * *